US008505156B2

(12) United States Patent
Goff

(10) Patent No.: US 8,505,156 B2
(45) Date of Patent: Aug. 13, 2013

(54) FLOOR CLEANING APPARATUS WITH SURFACE DRYER

(75) Inventor: Sean K. Goff, Bristol, WI (US)

(73) Assignee: RPS Corporation, Racine, WA (US)

( * ) Notice: Subject to any disclaimer, the term of this patent is extended or adjusted under 35 U.S.C. 154(b) by 1253 days.

(21) Appl. No.: 11/859,255

(22) Filed: Sep. 21, 2007

(65) Prior Publication Data

US 2009/0078281 A1 Mar. 26, 2009

(51) Int. Cl.
*E01H 1/08* (2006.01)

(52) U.S. Cl.
USPC ..... 15/340.1

(58) Field of Classification Search
USPC ..... 15/320, 340.1, 119.2, 97.1, 98, 353, 15/383; 134/6
See application file for complete search history.

(56) References Cited

U.S. PATENT DOCUMENTS 3,177,794 A * 4/1965 Laing ..... 454/121
4,989,293 A * 2/1991 Bashyam ..... 15/383
5,691,123 A * 11/1997 Coltrain et al. ..... 430/495.1
6,495,215 B1 * 12/2002 Kamikawa ..... 427/541
2004/0216325 A1 * 11/2004 Minami et al. ..... 34/549
2005/0183231 A1 * 8/2005 Mein ..... 15/321
2006/0048331 A1 * 3/2006 Rau et al. ..... 15/340.2

OTHER PUBLICATIONS

R.P.S. Corporation, Factory Cat, 290/350 Series, Operator Parts Manual (Nov. 23, 2005).

* cited by examiner

*Primary Examiner* — Robert Scruggs
(74) *Attorney, Agent, or Firm* — Quarles & Brady LLP

(57) ABSTRACT

A floor cleaning apparatus includes a chassis having a forward end and a rearward end. A plurality of floor engaging wheels support the chassis above a floor. A first tank is supported by the chassis for holding a cleaning solution that is dispensed onto the floor. A second tank is supported by the chassis for holding cleaning solution recovered from the floor. A squeegee assembly is supported by the chassis rearwardly of the forward end and in fluid communication with the second tank, wherein recovered cleaning solution drawn into the squeegee assembly is deposited into the second tank. A gas is directed toward the floor rearwardly of the squeegee assembly along substantially the entire length of the squeegee assembly to evaporate cleaning solution dispensed from the first tank and not recovered by the squeegee assembly.

9 Claims, 10 Drawing Sheets

FLOOR CLEANING APPARATUS WITH SURFACE DRYER

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

The field of invention is floor cleaning equipment, and more particularly, floor cleaning equipment for use in industrial and commercial environments.

Industrial and commercial floors are cleaned on a regular basis for aesthetic and sanitary purposes. There are many types of industrial and commercial floors ranging from hard surfaces, such as concrete, terrazzo, wood, and the like, which can be found in factories, schools, hospitals, and the like, to softer surfaces, such as carpeted floors found in restaurants and offices. Different types of floor cleaning equipment, such as scrubbers, sweepers, and extractors, have been developed to properly clean and maintain these different floor surfaces.

A typical scrubber for use on hard surfaces, such as Factory Cat scrubbers available from R.P.S. Corporation, Racine, Wis., is a walk-behind or drivable, self-propelled, wet process machine which applies a liquid cleaning solution from an on-board cleaning solution tank on to floor. Rotating brushes forming part of the scrubber agitate the solution to loosen dirt and grime adhering to the floor. The dirt and grime become suspended in the solution which is collected by a vacuum squeegee fixed to a rearward portion of the scrubber and deposited into an onboard recovery tank.

Although the vacuum squeegee collects substantially all of the solution from the floor, a thin film of solution extending the length of the squeegee assembly remains. This thin film evaporates over a period of time. However, prior to evaporation of the film, the floor should remain clear of pedestrians and vehicles. It is desirable to expedite the evaporation of the thin film.

BRIEF SUMMARY OF THE INVENTION

The present invention provides a floor cleaning apparatus and method of operation that expedite evaporation of the film of cleaning solution left by the squeegee assembly. The floor cleaning apparatus includes a chassis having a forward end and a rearward end. A plurality of floor engaging wheels support the chassis above a floor. A first tank is supported by the chassis for holding a cleaning solution that is dispensed onto the floor. A second tank is supported by the chassis for holding cleaning solution recovered from the floor. A squeegee assembly is supported by the chassis rearwardly of the forward end and in fluid communication with the second tank, wherein recovered cleaning solution drawn into the squeegee assembly is deposited into the second tank. A gas is directed toward the floor rearwardly of the squeegee assembly along substantially the entire length of the squeegee assembly to evaporate cleaning solution dispensed from the first tank and not recovered by the squeegee assembly.

A general objective of the present invention is to provide a floor cleaning apparatus that expedites evaporation of the film of cleaning solution left by the squeegee assembly. The objective is accomplished by providing a floor cleaning apparatus that directs gas toward the floor rearwardly of the squeegee assembly along substantially the entire length of the squeegee assembly to evaporate cleaning solution dispensed from the first tank and not recovered by the squeegee assembly.

The foregoing and other objectives and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
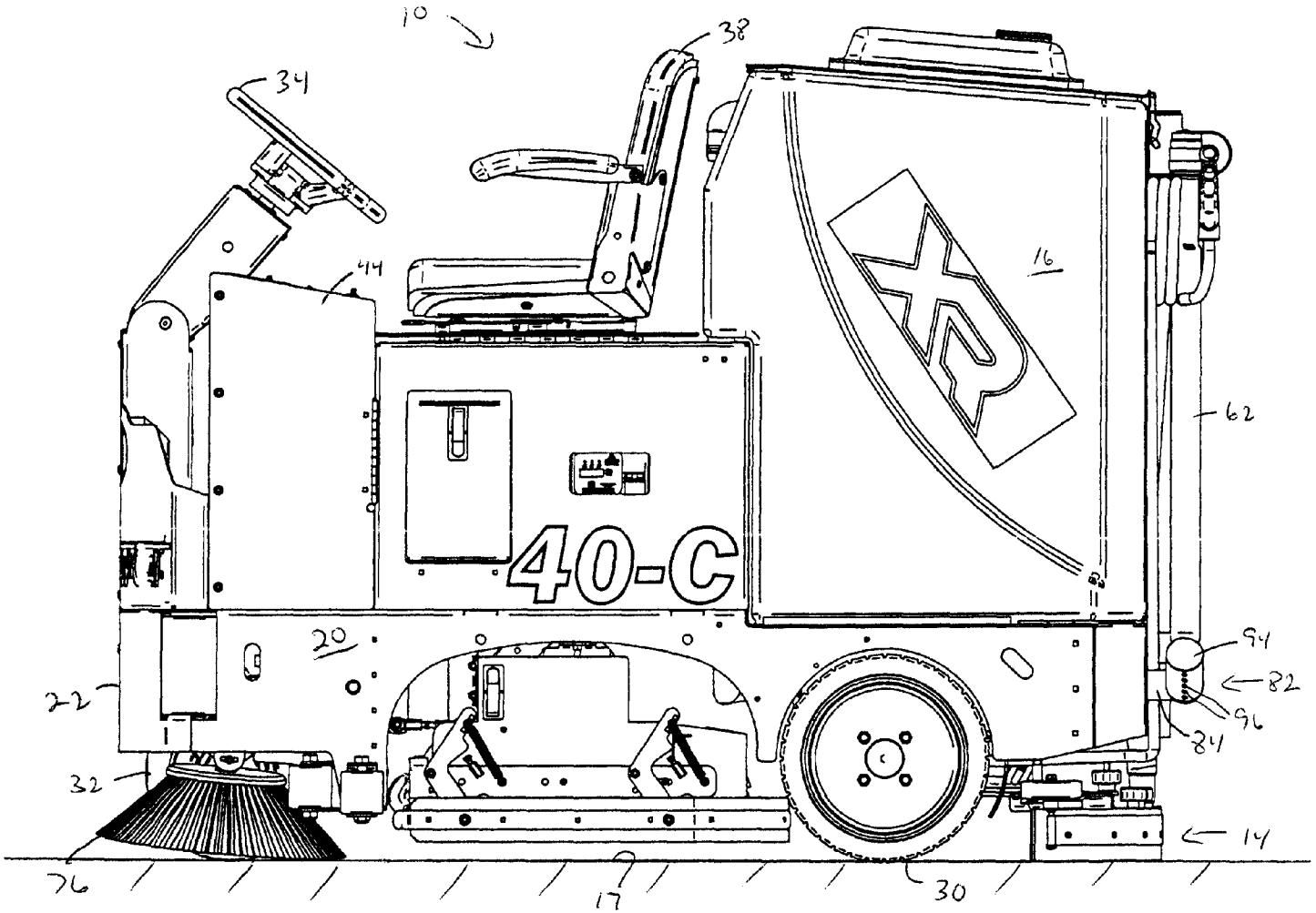
FIG. 1 is a right side view of a cleaning apparatus incorporating the present invention.
Figure 2:
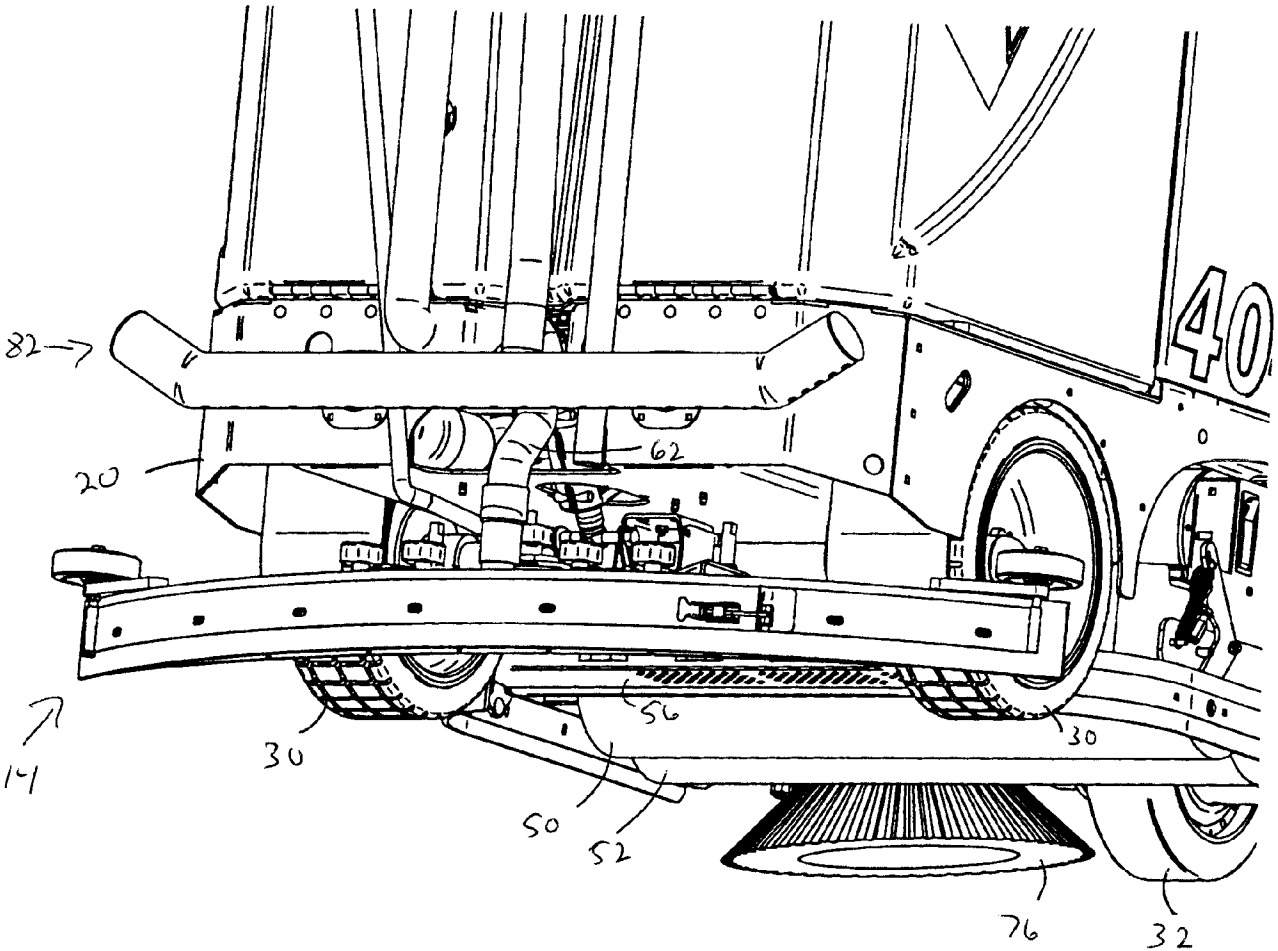
FIG. 2 is a partial, bottom, rear perspective view of the apparatus of FIG. 1.
Figure 3:
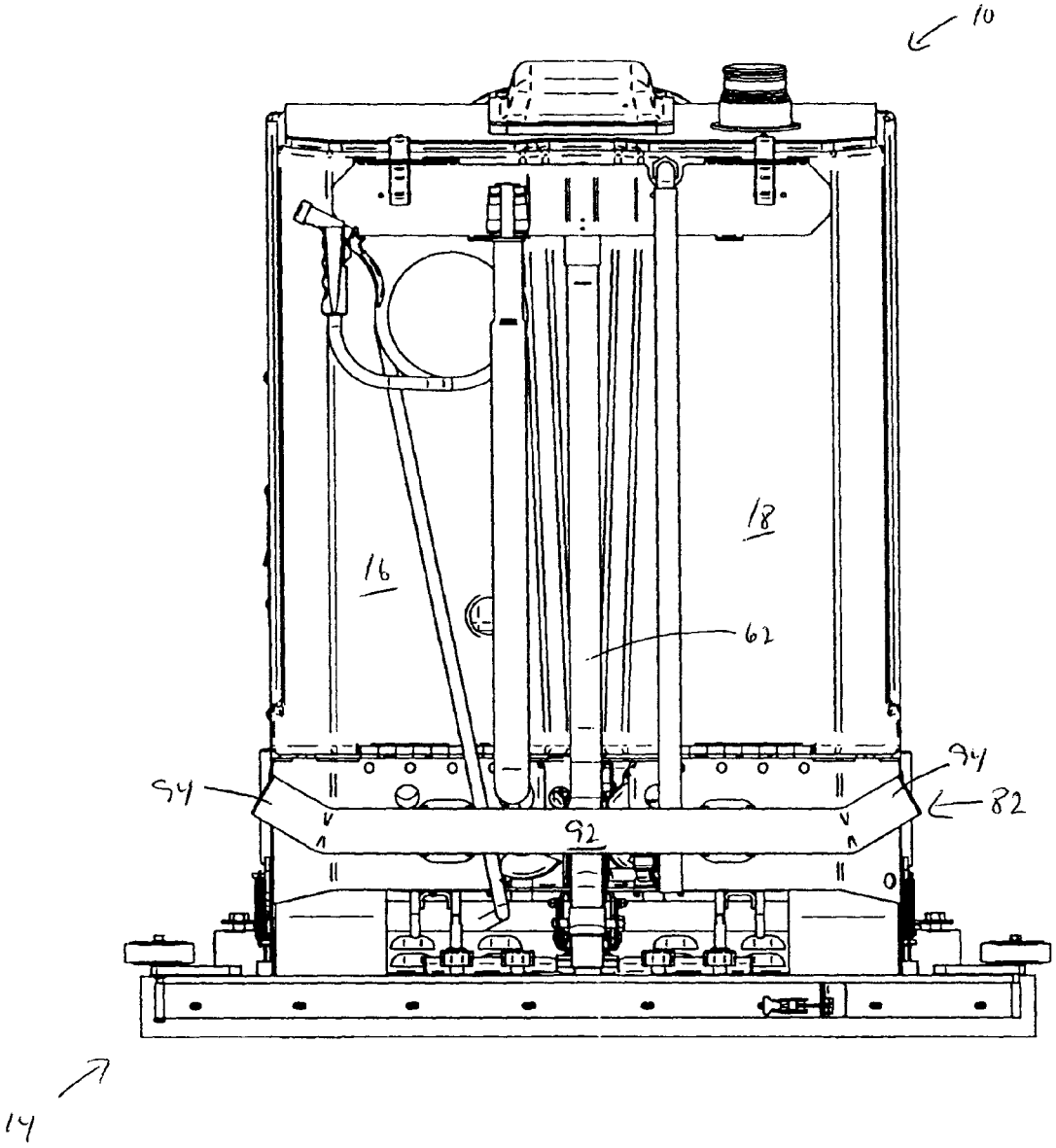
FIG. 3 is a rear view of the apparatus of FIG. 1.
Figure 4:
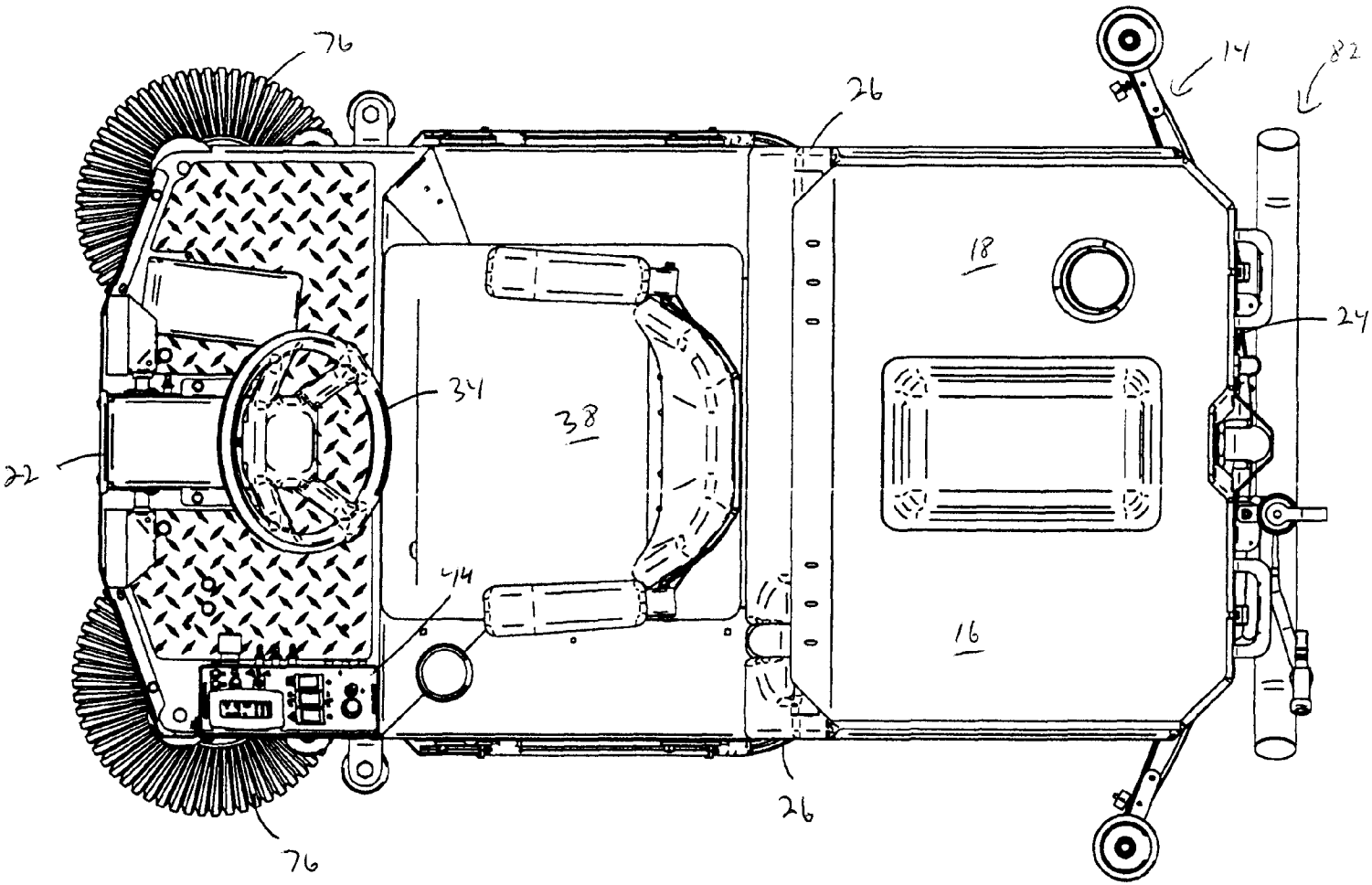
FIG. 4 is a top view of the apparatus of FIG. 1.

A drivable wet process floor cleaning apparatus 10, such as a Factory Cat XR Scrubber available from R.P.S. Corporation in Racine, Wis., incorporating the present invention is shown in FIGS. 1-4. As is known in the art, the apparatus 10 dispenses a liquid cleaning solution from an onboard cleaning solution tank 16 onto the floor 17 being cleaned, agitates the cleaning solution, and then using suction draws the cleaning solution into an on board recovery tank 18 through a vacuum squeegee assembly 14 which removes substantially all of the agitated cleaning solution from the surface of the hard floor 17 being cleaned by the apparatus 10.

The drivable apparatus 10 includes a chassis 20 having a front end 22 and a rear end 24 joined by sides 26. The chassis 20 is supported by floor engaging rear wheels 30 and a front steerable wheel 32. The steerable wheel 32 is operatively connected to a steering wheel 34 through the chassis 20 proximal the chassis front end 22. Although a riding floor cleaning apparatus is disclosed, the present invention can be incorporated into a walk-behind floor cleaning apparatus without departing from the scope of the invention.

The chassis 20 houses a plurality of batteries (not shown) which provide electrical power to an electric drive motor coupled to the steerable wheel 32. The batteries also provide electrical power to other electrical components described below. The drive motor rotatably drives the steerable wheel 32 to propel the apparatus 10 along the floor 17. Although an electric motor powered by the batteries for rotatably driving the steerable wheels 32 is preferred, the rear wheels 30 can be rotatably driven by an electric motor, and/or the steerable wheel 32 can be driven by other means, such as an internal combustion engine powered by gasoline, natural gas, and the like, without departing from the scope of the invention.

A driver seat 38 is supported by the chassis 20 rearward of the steering wheel 34 for use by an operator operating the apparatus 10. The operator sits on the driver seat 38 to operate the steering wheel 34 and foot operated control pedals, such as a brake and accelerator supported above the chassis top surface 42. The onboard tanks 16, 18 are supported by the chassis 20 rearwardly of the driver seat 38 and proximal the chassis rear end 24. The tanks 16, 18 can be formed from any material known in the art, such as plastic, metal, fiberglass, and the like without departing from the scope of the invention.

A control panel 44 is supported by the chassis 20 proximal one of the chassis sides 26 and within reach of the operator sitting on the driver seat 38. The control panel 44 houses circuitry for controlling the drive motor and the other electrical components described below. Control circuitry for controlling motors, pumps, and other electrical components is known in the art, such as control circuitry available on FactoryCat cleaning equipment available from R.P.S. Corporation in Racine, Wis.

In a preferred embodiment, the apparatus 10 dispenses the cleaning solution onto the floor 17 proximal the chassis front end 22 as the apparatus 10 is driven on the floor 17 by the operator. The cleaning solution can be gravity fed or pumped out of the cleaning solution tank 16 without departing from the scope of the invention. Any means for dispensing the cleaning solution onto the floor 17, such as dispensing the cleaning fluid through a spray bar, brushes, nozzles, and the like, can be used without departing from the scope of the invention.

The cleaning solution sprayed onto the floor 17 is agitated by a pair of retractable, cylindrical, counter rotating brushes 50, 52 disposed rearwardly of the mechanism dispensing the cleaning solution. The brushes 50, 52 have parallel axes of rotation which are aligned transverse to the apparatus longitudinal centerline to provide a forward brush 50 and a rearward brush 52. The counter rotating brushes 50, 52 are rotatably driven by an electrical motor, and agitate the cleaning solution on the floor 17 using radially extending bristles to dislodge dirt and grime adhering thereto. Advantageously, the dirt and grime are then suspended in the cleaning solution which can be drawn into the recovery tank 18, as described below. Although counter rotating cylindrical brushes are shown, other agitating means, such as one or more disk brushes, a single cylindrical brush, and the like, can be used without departing from the scope of the invention.

Debris on the floor 17 is swept up off of the floor 17 between the counter rotating brushes 50, 52 by the brush bristles to eliminate the need to sweep the floor 17 before cleaning. The rearward brush 52 deposits the debris in a strainer 56 disposed rearwardly of the rearward brush 52.

Figure 5:
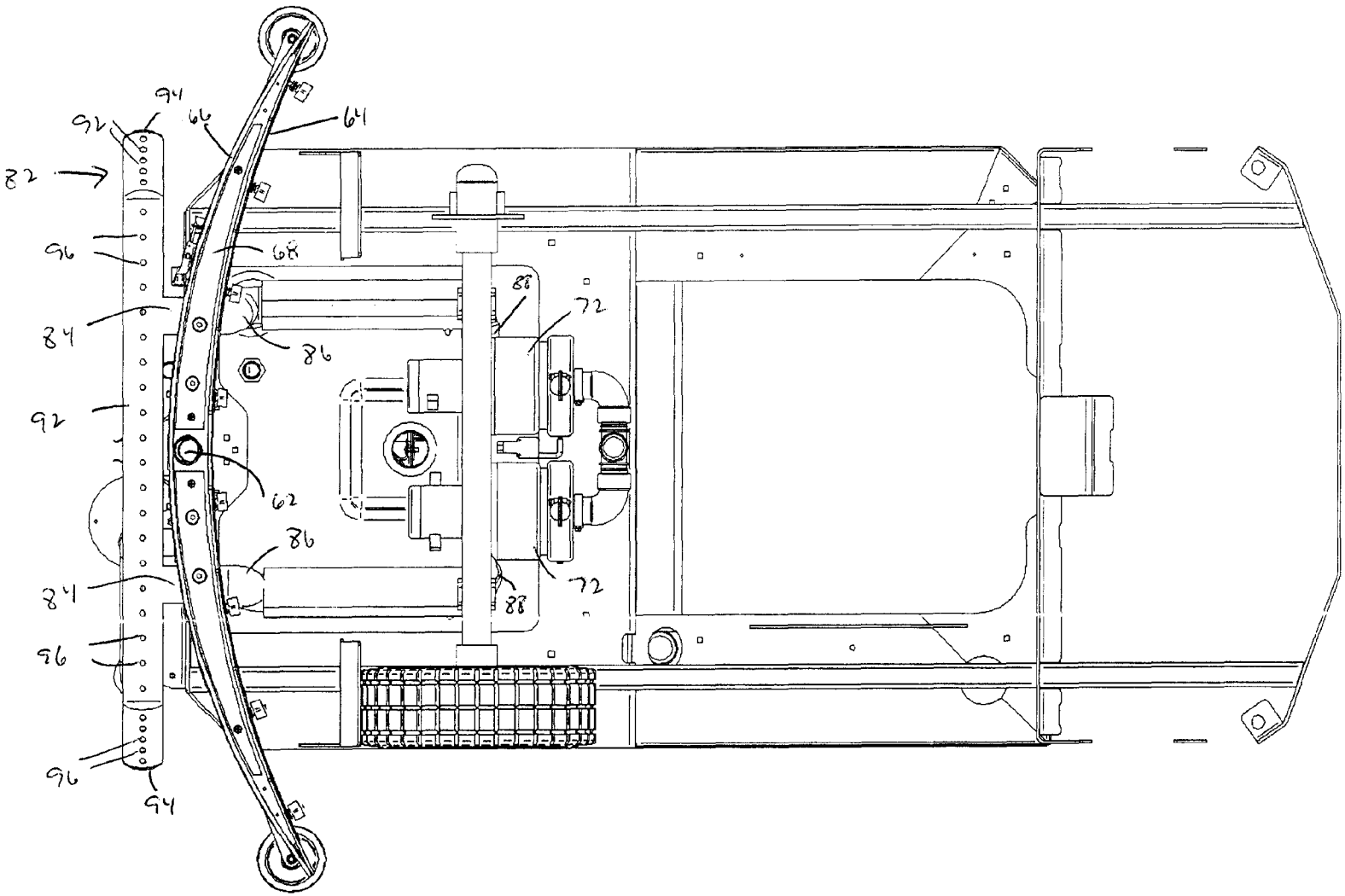
FIG. 5 is a partial bottom view of the apparatus of FIG. 1.
Figure 6:
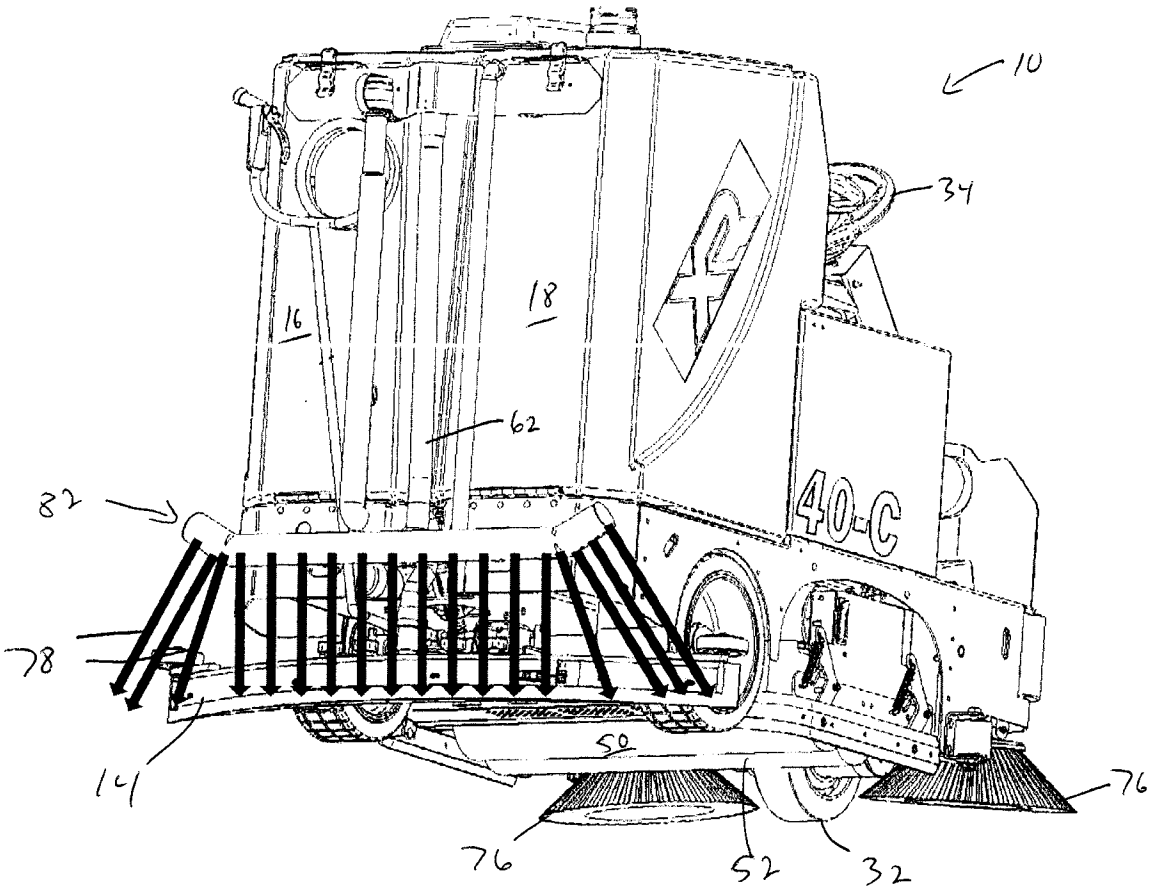
FIG. 6 is a bottom right rear view of the apparatus of FIG. 1 showing gas expelled from the exhaust diffuser.

Referring to FIG. 5, the squeegee assembly 14 is fixed to the chassis 20 and includes a forward arcuate squeegee strip 64 nested in a rearward arcuate squeegee strip 66. The nested squeegee strips 64, 66 extend across the width of the apparatus, and define a vacuum zone 68 in fluid communication with a recovery hose 62. Preferably, the strips 64, 66 are formed from a flexible, elastomeric material, such as rubber, plastic, and the like, which can sealingly engage the floor 17. A vacuum source in fluid communication with the vacuum zone collects the cleaning solution on the floor 17 with the exception of a thin film of cleaning solution which forms behind the apparatus 10 as the apparatus 10 travels in a forward direction. Although a crescent shaped vacuum zone is shown, any shaped vacuum zone, such as a provided in a straight squeegee assembly, can be used without departing from the scope of the invention.

Preferably, the vacuum source is a pair of vacuum pumps 72 in fluid communication with an upper portion of the recovery tank 18. The vacuum pumps 72 draw air out of the recovery tank 18 to create a partial vacuum. The partial vacuum creates a suction in the recovery hose 62 in fluid communication with the partial vacuum in the upper portion of the recovery tank 18 which draws the cleaning solution into the recovery tank 18 from the vacuum zone 68 of the squeegee assembly 14. Although dual vacuum pumps are disclosed, one or more vacuum pumps can be provided to provide the desired suction without departing from the scope of the invention.

Advantageously, the thin film of cleaning solution left on the floor 17 is removed by drying the surface of the floor 17 using heated gas 78, such as air, exhausted by the vacuum pumps 72. The heated gas 78 is preferably directed toward the floor 17 along the length of the squeegee assembly 14 to evaporate the residual liquid extending substantially the entire width of the apparatus 10. In a preferred embodiment, the heated gas 78 passes through an exhaust diffuser 82 which distributes the exhaust rearwardly of the squeegee assembly 14 substantially the entire length of the squeegee assembly 14. In the embodiment disclosed herein, the gas exhausted from the vacuum pumps is air heated about 20%-25% above ambient temperature. Although exhausting heated gas from the vacuum pumps 72 into the diffuser 82 is preferred because it is a readily available source of heated gas on a scrubber, any source of gas (heated or unheated), such as an independent heater, an internal combustion engine, blower, and the like can be used, without departing from the scope of the invention.

As shown in FIGS. 1-6, the diffuser 82 is fixed to the rear end 24 of the chassis 20 and has an inlet 84 in fluid communication, such as by piping 86, with each of the vacuum pump exhausts 88. In a preferred embodiment, the diffuser 82 is an elongated tube 92 having closed ends 94 and extending the width of the chassis. The two inlets 84, each in fluid communication with an exhaust 88 of one of the vacuum pumps 72, directs the heated gas into an interior volume of the elongated tube 92.

Apertures 96 spaced along the length of the tube 92 exhaust the heated gas 78 toward the floor 17 to dry the residual cleaning solution film. The apertures 96 are sized and spaced along the length of the diffuser 82 to evenly exhaust the heated gas 78 onto the residual cleaning solution film. Preferably, the heated gas 78 is exhausted along the entire length of the squeegee assembly 14. Although apertures 96 formed in the diffuser 82 are preferred, other openings in the diffuser, such as one or more slits formed in the diffuser directing gas toward the cleaning solution film, can be provided without departing from the scope of the invention.

In a preferred embodiment, the gas pressure in the diffuser tube 92 is maintained at a level that prevents disrupting operation and efficiency of the vacuum pumps 72. This can be accomplished by maintaining a pressure in the diffuser tube 92 that is no greater than the pressure of the heated gas exhausted by the vacuum pumps 72. In one embodiment, the apertures 96 are sized such that the sum of the areas of the apertures 96 is approximately equal to the sum of the areas of the inlets 84 to have prevent excessive pressure in the diffuser 82 that can disrupt the operation and efficiency of the vacuum pumps 72. Of course, if the exhaust gas is restricted upstream of the inlets and the upstream restrictions restrict the flow of gas greater than the inlets, the sum of the areas of the greatest upstream restrictions should be approximately equal to the sum of the areas of the apertures 96.

A positive pressure in the diffuser 82 is, however, preferred to ensure the heated gas is evenly exhausted through the apertures 96. Therefore in a preferred embodiment, the sum of the areas of the apertures 96 is slightly (i.e. 1 to 2%) less than the sum of the areas of the inlets 84. Of course, the gas pressure inside the diffuser 82 can be regulated by a relief valve to maintain a desired pressure in the diffuser 82 without departing from the scope of the invention.

The closed ends 94 of the diffuser are preferably angled upwardly to exhaust the heated gas 78 outwardly beyond the diffuser ends 94. Advantageously, angling the ends 94 of the diffuser 82 allows the diffuser 82 to extend between the chassis sides 26 short of the length of the squeegee assembly while exhausting the heated gas 78 substantially the entire length of the squeegee assembly 14 which extends beyond the chassis sides. Of course, the diffuser 82 can be extended beyond the chassis sides 26 without departing from the scope of the invention. Moreover, although directing the gas 78 using a diffuser 82 is preferred, the gas 78 can be directed toward the cleaning solution film using other methods, such as one or more nozzles adapted to distribute the gas along substantially the entire length of the squeegee assembly, without departing from the scope of the invention.

Referring back to FIGS. 1 and 2, a pair of side disk brushes 76 are rotatably mounted proximal the chassis front end 22 forward of the cylindrical brushes 50, 52, and are driven by an electrical motor controlled by the control circuitry and powered by the batteries. Each side brush 76 is rotatable about a vertical axis proximal one of the chassis sides 26, and urges debris towards a centerline of the chassis 20 for pick up by the cylindrical brushes 50, 52. Preferably, each side brush 76 extends radially from its vertical axis past one side 26 of the chassis 20 in order to sweep the floor 17 along a wall, or other vertical surface.

Referring to FIGS. 1-6, in operation, as the operator drives the apparatus 10 across the floor 17, the apparatus 10 dispenses cleaning solution from the cleaning solution tank 16 onto the floor 17. The cylindrical brushes 50, 52 counter rotate to agitate the cleaning solution on the floor 17 and pick up debris swept into the path of the apparatus 10 by the side brushes 76. The debris picked up by the cylindrical brushes 50, 52 is deposited into the strainer 56 for later removal by the operator. As the apparatus 10 moves across the floor 17, the agitated cleaning solution is collected by the squeegee assembly 14 and drawn off of the floor 17 by the vacuum source and deposited into the recovery tank 18 for later disposal. In the preferred embodiment, heated exhaust gas 78 from the vacuum source is directed toward the floor 17 rearwardly of the squeegee assembly 14 through the diffuser 82 to dry the thin film of cleaning solution left on the floor by the squeegee assembly 14.

Figure 8:
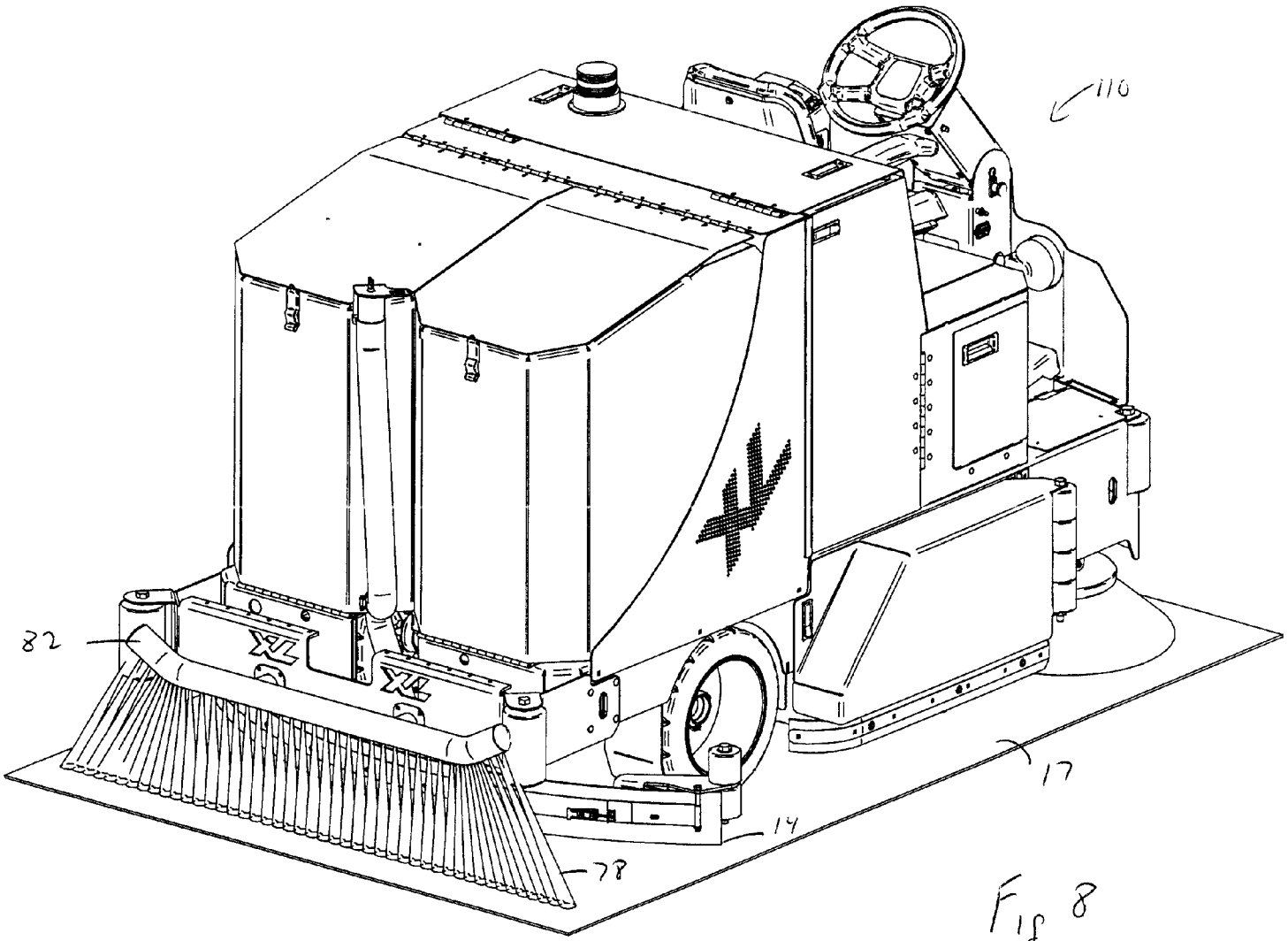
FIG. 8 is a rear perspective view of another cleaning apparatus incorporating the present invention.
Figure 9:
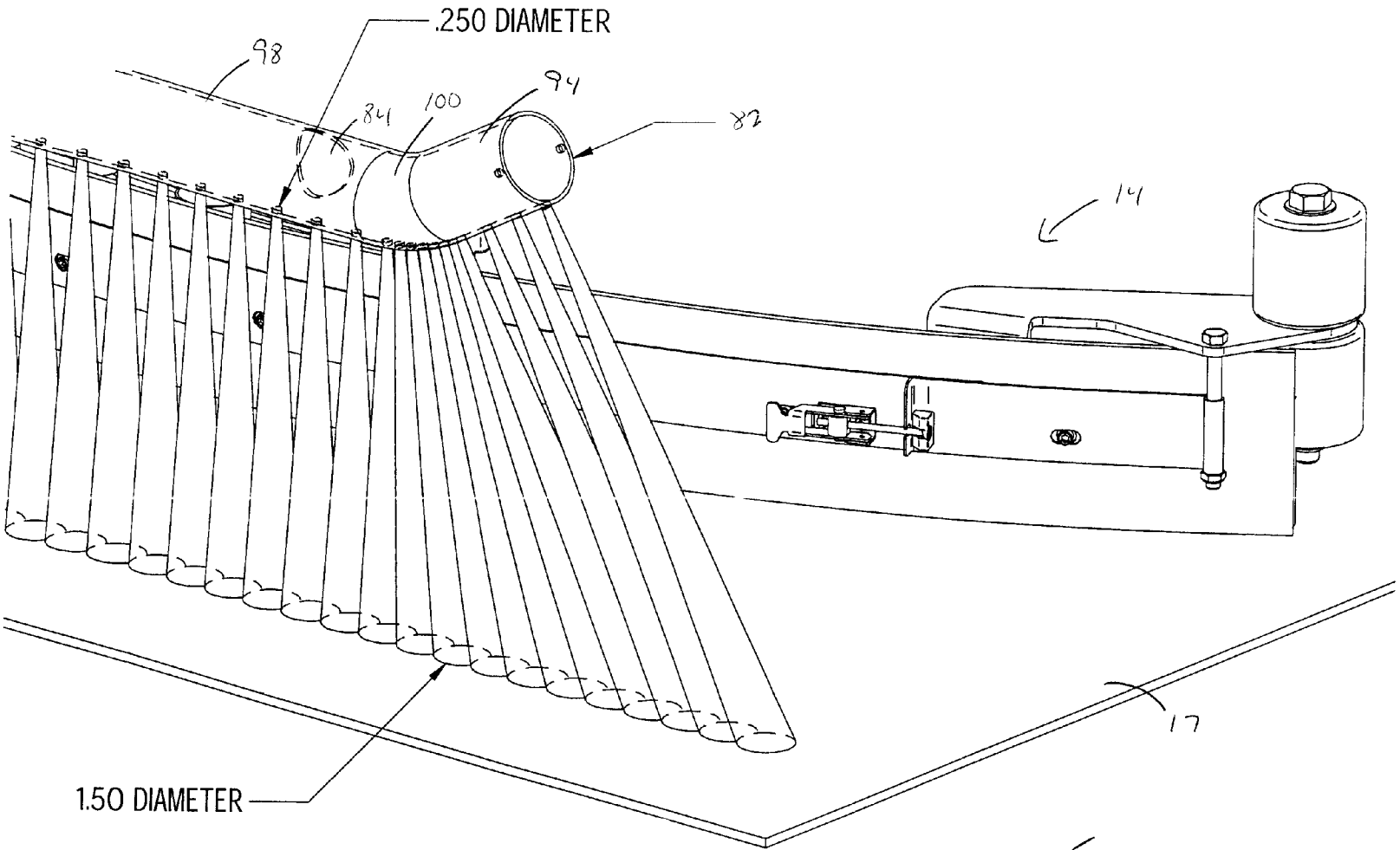
FIG. 9 is a detailed perspective view of the diffuser of the apparatus of FIG. 8.
Figure 10:
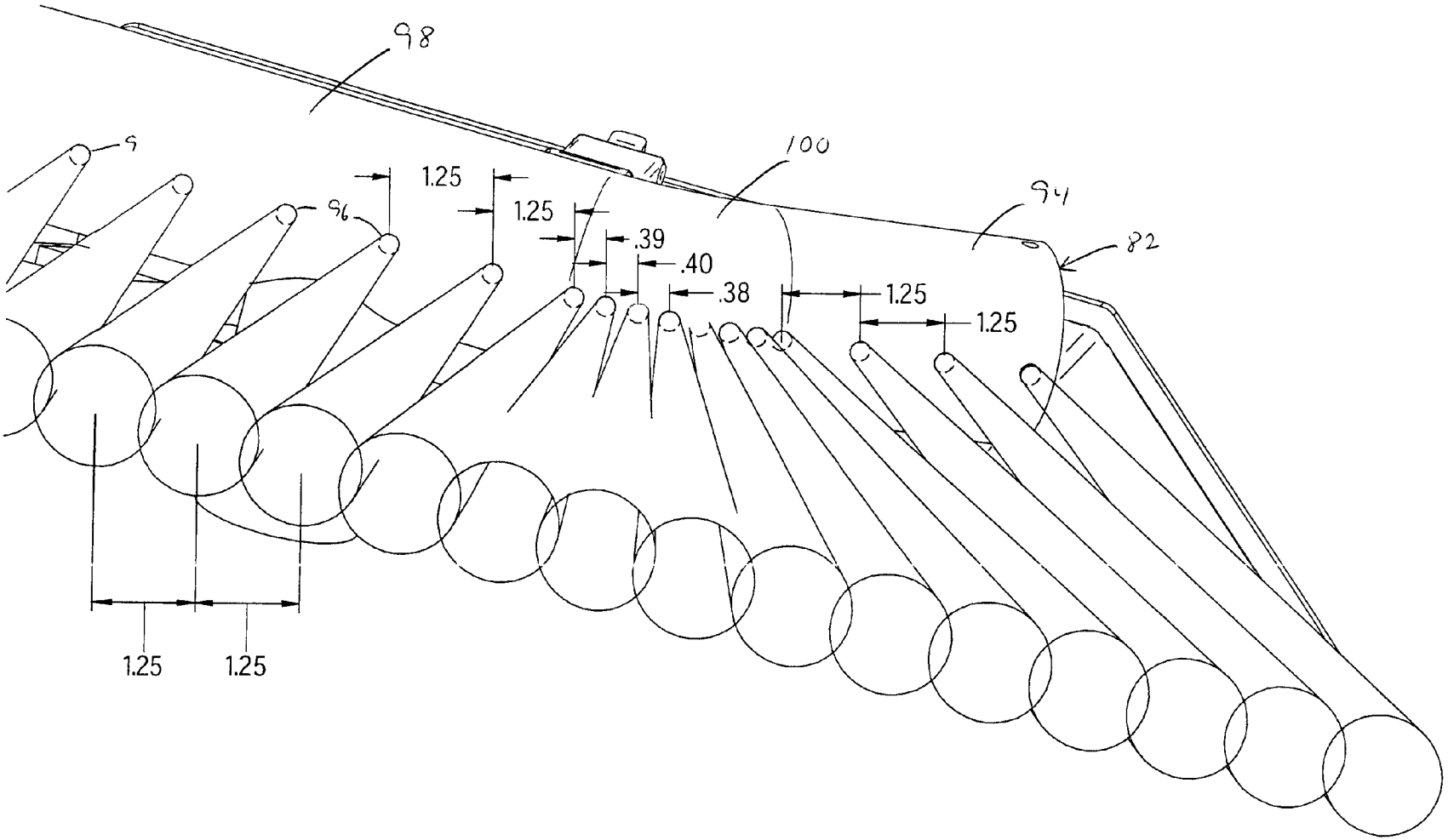
FIG. 10 is detailed perspective view of the diffuser aperture spacing of the apparatus of FIG. 8.

Properly sized and spaced apertures exhaust the available gas 78 in a diverging cone which slightly overlap at the floor 17 to evenly evaporate the film of cleaning solution. In a preferred embodiment of the present invention shown in FIGS. 8-10, the apertures 96 are sized and spaced to exhaust an even flow of gas 78 from the vacuum pumps 72 along substantially the entire length of the squeegee assembly 14 to evenly evaporate the film of cleaning solution. Along a straight section 98 of the diffuser 82, this is accomplished by evenly spacing the apertures 96 along the length of the straight section 98. Closer spacing of the apertures 96 is required at a transition portion 100 of the diffuser 82 between the straight section 98 and angled closed end 94. Apertures 96 along the straight angled closed end 94 are then also evenly spaced.

The aperture size and spacing necessary to evenly evaporate the film and cleaning solution is dependent upon the pressure inside the diffuser 82 and the height of the diffuser 82 above the floor 17. In the embodiment shown in FIGS. 8-10, a Factory Cat XL Scrubber 110, available from RPS Corporation, Racine, Wis., a pair of vacuum pumps, such as described above exhausts into the diffuser 82, which is approximately fourteen inches above the floor 17. Apertures 96 having a diameter of approximately 0.25 inches and spaced 1.25 inches apart along the straight section 98 of the diffuser 82 and ends 94 with closer spacing along the transition portion 100 provide a substantially even flow of gas 78 along substantially the entire length of the squeegee assembly 14.

Figure 7:
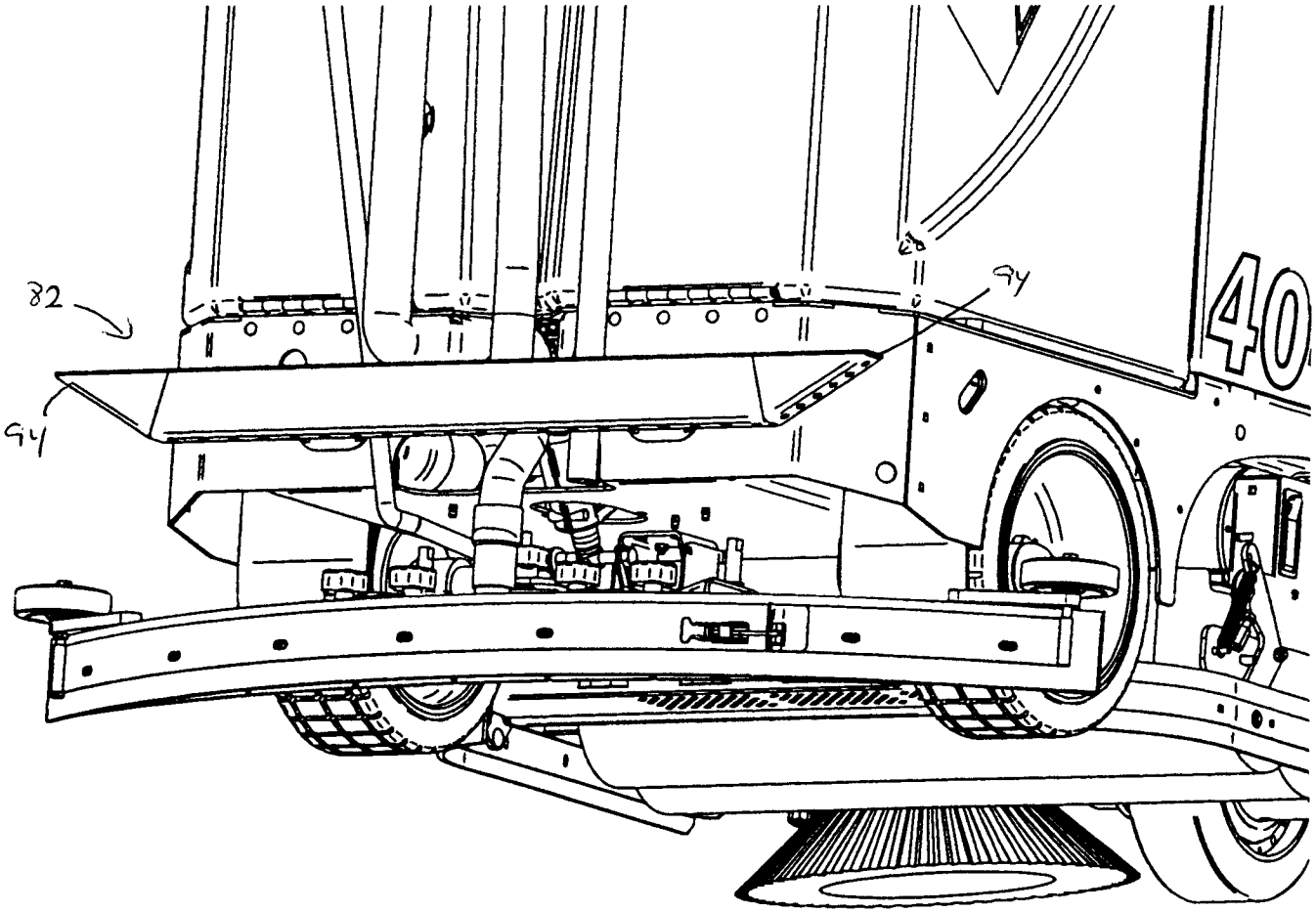
FIG. 7 is a partial, bottom, rear perspective view of the apparatus of FIG. 1 showing an alternate diffuser.

While there have been shown and described what is at present considered the preferred embodiments of the invention, it will be obvious to those skilled in the art that various changes and modifications can be made therein without departing from the scope of the invention defined by the appended claims. For example, as shown in FIG. 7, the diffuser 82 is formed from a square tube 92 having tapered ends 94 to direct the gas downwardly and beyond the length of the diffuser 82.

I claim:

1. A floor cleaning apparatus comprising:

a chassis having a forward end and a rearward end;

a plurality of floor engaging wheels supporting said chassis above a floor;

a first tank supported by said chassis for holding a cleaning solution that is dispensed onto the floor;

a second tank supported by said chassis for holding cleaning solution recovered from the floor;

a vacuum source in fluid communication with said second tank draws recovered cleaning solution into said second tank and leaves a film of cleaning solution on the floor;

a diffuser supported by said chassis directing gas toward the floor along substantially the entire width of said chassis to evaporate cleaning solution dispensed from said first tank and not recovered by said vacuum source; and a gas source exhausting a gas into said diffuser at a first pressure, and said diffuser exhausting said gas out of openings of said diffuser at rate that maintains a positive pressure in said diffuser no greater than said first pressure to ensure said gas is evenly distributed through said openings without disrupting efficiency of said gas source.

2. The floor cleaning apparatus as in claim 1, in which said diffuser receives said gas through at least one inlet and exhausts said gas through apertures spaced along a length of said diffuser.

3. The floor cleaning apparatus as in claim 2, in which each of said apertures defines an area through which said gas is exhausted and said at least one inlet defines an area through which said gas is received, and the sum of the areas of said apertures is no less than the sum of the areas of said at least one inlet.

4. The floor cleaning apparatus as in claim 1, in which said vacuum source is in fluid communication with a vacuum zone defined by a squeegee assembly fixed relative to said chassis.

5. The floor cleaning apparatus as in claim 1, in which at least one end of said diffuser is angled to direct the gas outwardly beyond said at least one end.

6. The floor cleaning apparatus as in claim 1, in which said gas is heated.

7. The floor cleaning apparatus as in claim 1, in which said gas source is said vacuum source exhausting said gas into said diffuser.

8. The floor cleaning apparatus as in claim 1, including at least one ground engaging agitation brush agitating the cleaning solution dispensed onto the floor.

9. The floor cleaning apparatus as in claim 1, in which at least one of said floor engaging wheels is rotatably driven to propel said chassis along the floor, and at least one of said ground engaging wheels is steerable by an operator supported by said chassis.

* * * * *